US008245844B2

(12) United States Patent
Sorrentino et al.

(10) Patent No.: US 8,245,844 B2
(45) Date of Patent: Aug. 21, 2012

(54) DISPLAY PACKAGE

(75) Inventors: Alan Sorrentino, Cranbury, NJ (US); Robert Moskovich, East Brunswick, NJ (US); Andreas Haefliger, Triengen (CH)

(73) Assignee: Colgate-Palmolive Company, New York, NY (US)

( * ) Notice: Subject to any disclaimer, the term of this patent is extended or adjusted under 35 U.S.C. 154(b) by 204 days.

(21) Appl. No.: 12/724,839

(22) Filed: Mar. 16, 2010

(65) Prior Publication Data

US 2010/0230312 A1 Sep. 16, 2010

Related U.S. Application Data

(60) Provisional application No. 61/160,481, filed on Mar. 16, 2009.

(51) Int. Cl.
*B65D 85/00* (2006.01)
*B65D 75/36* (2006.01)

(52) U.S. Cl. ..... 206/362.1; 206/362; 206/471

(58) Field of Classification Search ..... 206/362, 206/362.1, 362.2, 369, 463, 462, 461, 471, 206/459.5, 459.1; 220/23.83, 23.86
See application file for complete search history.

(56) References Cited

U.S. PATENT DOCUMENTS

| | | | | |
|---|---|---|---|---|
| D36,404 | S | | 3/1903 | Koch |
| 3,074,540 | A | | 1/1963 | Beich et al. |
| D196,988 | S | * | 11/1963 | Wills, Jr. et al. ..... D9/756 |
| D197,862 | S | | 3/1964 | Wills, Jr. |
| 3,369,660 | A | | 2/1968 | Hartman |
| 3,567,013 | A | | 3/1971 | Tannebaum |
| 3,759,375 | A | | 9/1973 | Nappi |
| D267,394 | S | | 12/1982 | Liptak et al. |
| RE3,157 | E | | 5/1984 | Mann |
| RE31,571 | E | | 5/1984 | Mann |
| 4,512,474 | A | | 4/1985 | Harding |
| D281,306 | S | | 11/1985 | Reichenstein |
| D281,580 | S | | 12/1985 | Stevens |
| D283,489 | S | | 4/1986 | Stevens |

(Continued)

FOREIGN PATENT DOCUMENTS

DE 2364259 6/1975

(Continued)

OTHER PUBLICATIONS

Written Opinion of the International Preliminary Examining Authority mailed Jun. 27, 2011 for corresponding International Application No. PCT/US2010/027449.

(Continued)

*Primary Examiner* — Steven A. Reynolds
(74) *Attorney, Agent, or Firm* — Judy W. Chung

(57) ABSTRACT

A package for displaying a plurality of items where the package has first and second containers connectable between an open position and a closed position, each container having an outer surface having at least one elongated protrusion, the at least one protrusion having a head end and a tail end, the head end extending further outwardly from the package than the tail end, and an inner surface having at least one inner cavity aligned with the at least one protrusion, the cavity having a depth varying along the protrusion and configured to receive one of the plurality of items, wherein the head end of the at least one protrusion of the first container is proximate the tail end of the at least one protrusion of the second container in the closed position.

16 Claims, 6 Drawing Sheets

U.S. PATENT DOCUMENTS

D291,064 S 7/1987 Haber et al.
D294,123 S 2/1988 Hill
4,756,419 A 7/1988 LeBras
4,759,935 A 7/1988 Toshitsugu
4,779,734 A 10/1988 Kydonieus
4,899,927 A 2/1990 Straub et al.
D306,404 S 3/1990 Hill
4,951,867 A 8/1990 McManus
5,018,622 A 5/1991 Hartley
5,022,525 A 6/1991 Schuster
5,025,964 A 6/1991 Phirippidis
5,029,702 A 7/1991 Tong
5,031,939 A 7/1991 Webendorfer et al.
5,048,684 A 9/1991 Scott
D320,930 S 10/1991 Richards
D321,323 S 11/1991 Nakamura
5,082,112 A 1/1992 Dunklee
5,094,347 A 3/1992 Schuster
5,121,835 A 6/1992 Grupe
5,129,527 A 7/1992 Lataix
5,135,158 A 8/1992 Boyle et al.
5,152,397 A 10/1992 Mayled
5,158,177 A 10/1992 Negelen et al.
5,195,633 A 3/1993 Kaminski
5,209,354 A 5/1993 Thornhill et al.
5,226,534 A 7/1993 Kim
5,244,091 A 9/1993 Tannenbaum
5,265,728 A 11/1993 Allendorf et al.
5,282,567 A 2/1994 Dickson
5,284,291 A 2/1994 Sellors
5,289,916 A 3/1994 Mickelberg
5,295,623 A 3/1994 Bacques et al.
5,297,673 A 3/1994 Sutherland
D345,909 S 4/1994 Winston
D346,114 S 4/1994 Winston
5,311,984 A 5/1994 Harris
5,311,989 A 5/1994 Ward et al.
D347,998 S 6/1994 Steenwinkel
5,323,907 A 6/1994 Kalvelage et al.
5,332,085 A 7/1994 Fraser
5,348,145 A 9/1994 Steinfel, III
D352,236 S 11/1994 Althaus
D354,679 S 1/1995 Dunn et al.
5,390,784 A 2/1995 Sutherland
5,390,848 A 2/1995 Gungner et al.
5,398,442 A 3/1995 Musket
5,407,066 A 4/1995 Grange
5,413,276 A 5/1995 Sheffer
5,414,890 A 5/1995 Morando
5,439,112 A 8/1995 DeGuglielmo et al.
5,443,203 A 8/1995 Sutherland
5,447,232 A 9/1995 Chow
5,456,352 A 10/1995 McQueeny
D364,561 S 11/1995 Chapman et al.
D365,984 S 1/1996 Hofmann
5,485,913 A 1/1996 Steinfel, III
5,485,919 A 1/1996 Samberg et al.
5,489,025 A 2/1996 Romick
D369,546 S 5/1996 Chapman et al.
5,520,283 A 5/1996 Sutherland
D371,068 S 6/1996 Chapman et al.
D371,069 S 6/1996 Chapman et al.
5,524,756 A 6/1996 Sutherland
5,540,381 A 7/1996 Davis
5,542,536 A 8/1996 Sutherland
5,544,755 A 8/1996 Paumen et al.
5,549,197 A 8/1996 Sutherland
5,549,204 A 8/1996 Toren
D373,306 S 9/1996 Baxter
5,558,224 A 9/1996 Fogle
5,579,990 A 12/1996 Durand
5,593,041 A 1/1997 Capozzi
5,595,047 A 1/1997 Paumen et al.
5,595,291 A 1/1997 Negelen
5,624,036 A 4/1997 Roulin et al.
5,653,340 A 8/1997 Daniel
5,671,845 A 9/1997 Harris
5,682,995 A 11/1997 Sutherland
5,685,420 A 11/1997 Martin et al.
5,695,056 A 12/1997 Bender et al.
5,697,502 A 12/1997 Linz
5,803,264 A 9/1998 Gersten et al.
5,826,728 A 10/1998 Sheffer
5,845,776 A 12/1998 Galbierz et al.
5,855,275 A 1/1999 Hunter et al.
5,857,612 A 1/1999 Smith et al.
5,881,885 A 3/1999 Grimm
5,881,977 A 3/1999 Danneberg
5,887,706 A 3/1999 Pohle et al.
D408,278 S 4/1999 Konop
5,913,426 A 6/1999 Lotz Renfro et al.
5,919,074 A 7/1999 Honda
5,921,392 A 7/1999 Davis
5,944,183 A 8/1999 Rowland et al.
5,957,289 A 9/1999 Negelen
5,967,406 A 10/1999 Moorman
5,984,086 A 11/1999 Foushee et al.
D419,063 S 1/2000 Baker et al.
6,012,573 A 1/2000 Kurimoto
6,015,043 A 1/2000 Sandberg et al.
D420,905 S 2/2000 Adkins
6,024,222 A 2/2000 Friberg et al.
D421,898 S 3/2000 Strange
6,045,038 A 4/2000 Smith et al.
D423,927 S 5/2000 Senyuva et al.
D425,414 S 5/2000 Baker et al.
6,059,106 A * 5/2000 Baker et al. ..... 206/361
D427,523 S 7/2000 Calcerano
6,116,420 A 9/2000 Hall et al.
D432,414 S 10/2000 Simpson et al.
6,138,828 A 10/2000 Bendix
D434,315 S 11/2000 Clarke
D439,158 S 3/2001 Forakis
6,199,692 B1 3/2001 Van Ness et al.
6,227,369 B1 5/2001 Glassman
6,237,773 B1 5/2001 Goldman
6,244,502 B1 6/2001 Hollar et al.
D444,380 S 7/2001 Matner
D446,713 S 8/2001 Adam
D449,780 S 10/2001 Corella
6,296,120 B1 10/2001 Danko
6,298,995 B1 10/2001 Schwester
6,305,598 B1 10/2001 Bryan
D451,382 S 12/2001 Adkins
6,325,209 B1 12/2001 Humphrey
6,357,593 B1 3/2002 Bolnick et al.
D455,071 S 4/2002 Ruben
6,364,115 B1 4/2002 Casanova et al.
6,378,765 B1 4/2002 Sutherland
6,386,369 B2 5/2002 Yuhas et al.
6,419,085 B1 7/2002 Humphrey
D461,713 S 8/2002 Foreman
6,431,543 B1 8/2002 Cole et al.
6,460,703 B1 10/2002 Thompson et al.
6,478,336 B2 11/2002 Tran
D470,046 S 2/2003 Chao
D470,385 S 2/2003 Chen
6,523,684 B1 2/2003 Daniels, Jr.
D471,443 S 3/2003 Chiang
D472,140 S 3/2003 Yang
6,581,777 B2 6/2003 Thibault
D478,810 S 8/2003 Wilson
6,615,985 B1 9/2003 Foreman
6,644,473 B2 11/2003 Kohler
6,651,846 B2 11/2003 Duquet et al.
D484,798 S 1/2004 Bukowski
6,726,011 B2 4/2004 Sarar et al.
6,736,260 B2 5/2004 Gomes et al.
6,749,060 B2 6/2004 Ford
6,758,338 B2 7/2004 Lien
6,793,071 B2 9/2004 Rhyne et al.
6,802,415 B2 10/2004 Loeffler
6,840,437 B2 1/2005 Chen
D501,791 S 2/2005 Geiberger et al.
6,871,778 B2 3/2005 Petrelli et al.
6,874,679 B2 4/2005 Tibbles et al.
6,877,600 B2 4/2005 Sutherland

| | | | | |
|---|---|---|---|---|
| D504,811 | S | 5/2005 | Haingaertner | |
| 6,889,829 | B2 | 5/2005 | Lev et al. | |
| 6,889,840 | B2 | 5/2005 | Schein et al. | |
| D506,146 | S | 6/2005 | Hall | |
| D506,147 | S | 6/2005 | Hall | |
| D506,397 | S | 6/2005 | Hall | |
| D507,756 | S | 7/2005 | Hall | |
| 6,920,980 | B2 | 7/2005 | Hwang et al. | |
| D512,330 | S | 12/2005 | Hall | |
| D513,596 | S | 1/2006 | Hamblin et al. | |
| 6,988,617 | B2 | 1/2006 | Gomes et al. | |
| D515,941 | S | 2/2006 | Hamblin et al. | |
| D515,942 | S | 2/2006 | Hamblin et al. | |
| D515,943 | S | 2/2006 | Hamblin et al. | |
| 6,997,372 | B2 | 2/2006 | Gasparowicz | |
| 7,000,774 | B2 | 2/2006 | Bryant | |
| D516,609 | S | 3/2006 | Rose | |
| 7,021,458 | B2 | 4/2006 | Cummings | |
| 7,073,705 | B2 | 7/2006 | Auclair et al. | |
| D525,866 | S | 8/2006 | Oliveira | |
| 7,083,046 | B2 | 8/2006 | Bakx | |
| 7,094,981 | B2 * | 8/2006 | Sorrentino et al. | 200/332.2 |
| 7,097,034 | B2 | 8/2006 | Woog | |
| D531,026 | S | 10/2006 | McMorris | |
| D532,612 | S | 11/2006 | Lamason et al. | |
| D532,690 | S | 11/2006 | Oliveira | |
| 7,137,508 | B2 | 11/2006 | Schultz et al. | |
| 7,159,721 | B2 | 1/2007 | Martin, Jr. | |
| D536,609 | S | 2/2007 | Moskovich et al. | |
| D538,676 | S | 3/2007 | Millen | |
| RE39,565 | E | 4/2007 | Humphrey | |
| 7,225,925 | B2 | 6/2007 | Chen et al. | |
| D548,619 | S | 8/2007 | Ferguson et al. | |
| D549,572 | S | 8/2007 | Althouse et al. | |
| 7,255,262 | B2 | 8/2007 | Duyst | |
| D552,466 | S | 10/2007 | Proudfit | |
| D554,492 | S | 11/2007 | Bochmann et al. | |
| D554,493 | S | 11/2007 | Bochmann et al. | |
| D554,495 | S | 11/2007 | Hanji et al. | |
| D556,569 | S | 12/2007 | Stein et al. | |
| D558,602 | S | 1/2008 | Kissner et al. | |
| D561,609 | S | 2/2008 | McMorris | |
| 7,341,153 | B2 | 3/2008 | DuBois et al. | |
| D567,646 | S | 4/2008 | Ballard | |
| 7,374,038 | B2 | 5/2008 | Smalley | |
| D570,684 | S | 6/2008 | Kisch | |
| 7,410,094 | B2 | 8/2008 | Bos | |
| 7,445,118 | B2 | 11/2008 | Schroeder | |
| 7,464,818 | B2 | 12/2008 | Gherdan et al. | |
| 7,469,814 | B2 | 12/2008 | Philips | |
| 7,484,654 | B2 | 2/2009 | Tibbles et al. | |
| D594,347 | S | 6/2009 | Sorrentino et al. | |
| D594,348 | S | 6/2009 | Sorrentino et al. | |
| 7,556,152 | B2 * | 7/2009 | Lechelle | 206/581 |
| D605,530 | S | 12/2009 | Sorrentino et al. | |
| 7,699,170 | B2 * | 4/2010 | Klein et al. | 206/499 |
| 7,886,905 | B2 * | 2/2011 | Kamada | 206/337 |
| D634,626 | S * | 3/2011 | Gustafson et al. | D9/434 |
| 2001/0054570 | A1 | 12/2001 | Danko | |
| 2003/0213705 | A1 | 11/2003 | Woog | |
| 2004/0108236 | A1 | 6/2004 | Reed et al. | |
| 2004/0182733 | A1 | 9/2004 | Dunlap | |
| 2005/0045526 | A1 | 3/2005 | Constant et al. | |
| 2005/0056688 | A1 | 3/2005 | Hsi-Ching | |
| 2005/0082194 | A1 | 4/2005 | Fry et al. | |
| 2005/0098616 | A1 | 5/2005 | Chang | |
| 2005/0112244 | A1 | 5/2005 | Hall | |
| 2006/0037999 | A1 | 2/2006 | Tibbels et al. | |
| 2006/0042988 | A1 | 3/2006 | Hjalmarsson | |
| 2006/0048486 | A1 | 3/2006 | Laing et al. | |
| 2006/0049240 | A1 | 3/2006 | LeBras | |
| 2006/0102512 | A1 | 5/2006 | Lo Duca | |
| 2006/0113215 | A1 | 6/2006 | Clements et al. | |
| 2006/0118461 | A1 | 6/2006 | Calendrille, Jr. | |
| 2006/0151585 | A1 | 7/2006 | Misjak | |
| 2006/0157545 | A1 | 7/2006 | Auclair | |
| 2006/0180643 | A1 | 8/2006 | Stephenson | |
| 2006/0255108 | A1 | 11/2006 | Shmagin | |
| 2006/0278561 | A1 | 12/2006 | Schierlmann | |
| 2007/0000806 | A1 | 1/2007 | Oliveira | |
| 2007/0187429 | A1 | 8/2007 | Farahmand | |
| 2007/0227943 | A1 | 10/2007 | Foushee | |
| 2007/0235367 | A1 | 10/2007 | Initini | |
| 2007/0272586 | A1 | 11/2007 | Hession | |
| 2008/0011637 | A1 | 1/2008 | Young et al. | |
| 2008/0023472 | A1 * | 1/2008 | Brandt | 220/4.23 |
| 2008/0087568 | A1 | 4/2008 | Jabri | |
| 2008/0116085 | A1 | 5/2008 | Artis et al. | |
| 2008/0120798 | A1 | 5/2008 | Sorrentino et al. | |
| 2008/0128428 | A1 | 6/2008 | Beckerman | |
| 2008/0156675 | A1 | 7/2008 | Sandow | |
| 2008/0217199 | A1 | 9/2008 | Burress et al. | |
| 2008/0223909 | A1 | 9/2008 | Gessler | |
| 2008/0302695 | A1 | 12/2008 | Meeren et al. | |
| 2008/0314794 | A1 | 12/2008 | Bowman | |
| 2009/0014353 | A1 | 1/2009 | Lewis, Jr. et al. | |
| 2009/0032434 | A1 | 2/2009 | Kim | |
| 2009/0044357 | A1 | 2/2009 | Chan et al. | |
| 2009/0045096 | A1 | 2/2009 | Knutson et al. | |

FOREIGN PATENT DOCUMENTS

| | | |
|---|---|---|
| EP | 0556836 | 8/1993 |
| EP | 0648686 | 4/1995 |
| EP | 0777617 A1 | 6/1997 |
| EP | 0784022 | 7/1997 |
| EP | 1477426 | 11/2004 |
| EP | 1504693 | 2/2005 |
| EP | 1723980 | 11/2006 |
| FR | 2276801 | 1/1976 |
| FR | 2673604 | 9/1992 |
| GB | 879186 | 10/1961 |
| WO | WO 93/16673 | 9/1993 |
| WO | WO 95/17116 | 6/1995 |
| WO | WO 97/02192 | 1/1997 |
| WO | WO 01/36291 | 5/2001 |
| WO | WO 02/32666 | 4/2002 |
| WO | WO 02/49936 | 6/2002 |
| WO | WO 03/104780 | 12/2003 |
| WO | WO 2005/087614 | 9/2005 |
| WO | WO 2006/119992 | 11/2006 |
| WO | WO 2007/044456 | 4/2007 |
| WO | WO 2007/067054 | 6/2007 |
| WO | WO 2008/016630 | 2/2008 |
| WO | WO 2008/039248 | 4/2008 |
| WO | 2008086389 | 7/2008 |
| WO | 2009000678 | 12/2008 |
| WO | WO 2008/146836 | 12/2008 |

OTHER PUBLICATIONS

International Search Report from the European Patent Office dated Nov. 26, 2010 relating to corresponding International Application No. PCT/US2010/027449.

Partial International Search Report in International Application No. PCT/US10/027449, mailed Jul. 9, 2010.

* cited by examiner

DISPLAY PACKAGE

CROSS REFERENCE TO RELATED APPLICATION

This application claims the benefit of U.S. Provisional Patent Application Ser. No. 61/160,481, filed Mar. 16, 2009, the contents of which is incorporated herein by reference.

BACKGROUND OF THE INVENTION

The present invention generally relates to a package for displaying a plurality of items.

Display packages of various types and configurations are well known in the art and are employed widely in the merchandising field for the display of a given product. Generally, such display packages are preformed closures such as blister or clamshell packages comprised of a substantially transparent polymeric material which allows the product to be viewed by the prospective consumer, and may take a number of forms or shapes depending upon the product to be sold. The package may be generally sealed to protect the items, maintain sanitary condition of the item and/or prevent damage during shipping and storage.

The prior art discloses various display packages. A package for a plurality of elongated swab type applicators is shown in U.S. Pat. No. 3,759,375. Each of the swab applicators is held in a separate sealed compartment and can be removed individually for use by removing the seal. However, this is not shown in a labeled form and as a display package. U.S. Pat. No. 5,048,684 discloses a compact package for syringes and catheters. A similar arrangement of packaged items also is shown in U.S. Des. 306,404. Improvements, however, can be made to these packages to increase their sustainability. The U.S. Patent Application 2006/0278561 discloses a display package for a group of coloration sticks for coloring wood and furniture. These are each in separate compartments of a two section display package with the sections connected by a hinge. This display package also has an aperture on an upper end so that it can be suspended from a prong by the merchant. However, it uses excess packaging material and is not shown in a labeled form. An unlabeled display package for a plurality of products, each in a separate compartment, is shown in U.S. Design Pat. 196,988. Two levels of separate product compartments, apparently for batteries, are shown. U.S. Pat. No. 5,018,622 discloses a battery display package for four batteries. This display package can be arranged for sale on a shelf or it can be suspended from a prong. However, it has a relatively large bulbous shape which limits the number of the packages that can be held on a prong at the point of sale. It also has a relatively large billboard type of label area which increases the amount of packaging material.

It would be desirable to provide a novel display package of high sustainability and which also maximizes the number of the display packages that can be held on the prongs of a point of sale rack. This is accomplished in the display package of the present invention

BRIEF SUMMARY OF THE INVENTION

The package of the present invention has a high degree of sustainability. The amount of packaging material used per packaged item is less than in many other types of packaging. In addition the package can be displayed in various ways by the merchant. The package can be displayed on a shelf and sold in a multi-pack format or can be suspended from a prong of a rack.

The present display package for a plurality of items further enhances the sustainability of such packages by reducing the overall packaging needed for the completed package, including the label. The label requirements are minimized in contrast to other label techniques, such as shrink wrap labeling. Further, the label remains a part of the package throughout its use. In addition, the display package has been developed to have an efficient stackable profile when suspended from the prongs of a rack so that a maximum number of the display packages can be neatly arranged for sale.

The invention is directed to a sustainable package for efficiently displaying a plurality of items where the package has first and second containers connectable between an open position and a closed position, each container having an outer surface having at least one elongated protrusion, the at least one protrusion having a head end and a tail end, the head end extending further outwardly from the package than the tail end, and an inner surface having at least one inner cavity aligned with the at least one protrusion, the cavity having a depth varying along the protrusion and configured to receive one of the plurality of items, wherein the head end of the at least one protrusion of the first container is proximate the tail end of the at least one protrusion of the second container in the closed position. The first and second containers can be connected by a hinge.

The at least one protrusion of the first container can be substantially the same size and shape as the at least one protrusion of the second container. In addition, each container can include two substantially identical protrusions each having substantially identical cavities, the head ends of the protrusions of the first container being proximate the tail ends of the protrusions of the second container in the closed position. The protrusions of each container can be laterally spaced from one another. The package further can have a generally planar front sheet of material affixed to and extending between the protrusions of the first container and optionally a planar rear sheet of material affixed to and extending between the protrusions of the second container. Each of the protrusions of the first container can be generally aligned with one of the protrusions of the second container in the closed position. The package further can include a first removable seal affixed to the inner surface of the first container sealing the cavities of the first container and a second removable seal affixed to the inner surface of the second container sealing the cavities of the second container, the first and second seals being concealed in the closed position and removable from the respective first and second container in the open position. The first and second removable seals can be each separable into at least two segments, each segment configured to individually seal one of the cavities.

The packaged items can be a toothbrush positioned within the at least one cavity and each of the cavities and the corresponding protrusion can generally be the same shape as the toothbrush. The brush head is received in the head end of the protrusion and is configured to face generally outwardly from the package in the closed position.

The package can have a first maximum thickness proximate a top of the package measured through the protrusions in the closed position and a second maximum thickness proximate a bottom of the package measured through the protrusions in the closed position, the first maximum thickness being generally equal to the second maximum thickness. The head and tail ends of each of the at least one protrusions are generally bulbous and are joined together by a generally rectangular portion.

The package can include a first removable seal affixed to the inner surface of the first container sealing the at least one cavity and a second removable seal affixed to the inner surface of the second container sealing the at least one cavity, the first and second seals being concealed in the closed position and removable from the respective first and second container in the open position.

The first container can have a lip proximate an outer periphery of the wall of the first container and the second container has an edge proximate an outer periphery of the wall of the second container, with the lip of the first container releasably engaging with the edge of the second container in the closed position.

There can be at least two elongated items where the package includes a container having an outer surface and an inner surface, the outer surface having at least two elongated protrusions, the at least two protrusions spaced laterally apart from one another, the inner surface having at least two cavities each aligned with one of the protrusions and configured to receive one of the elongated items, and a generally planar sheet of material affixed to and extending between the protrusions. The planar sheet can be opaque to at least semi-transparent and can carry at least one of product information and promotional material. The sheet can be confined between outer lateral edges of the protrusions. The elongated items can be toothbrushes.

In more detail there can be a disposable display package that includes four toothbrushes, first and second containers connectable between an open position and a closed position, each container having an outer surface having two elongated protrusions generally parallel to each other and spaced laterally apart from one another, the protrusions each having a generally bulbous head end and a generally bulbous tail end, the head end extending outwardly further than the tail end, the first and second generally bulbous ends joined together by a generally rectangular portion, an inner surface having two cavities each shaped similar to and aligned with one of the protrusions, each cavity containing one of the toothbrushes, and a removable seal affixed to the inner surface of the container and individually sealing each of the cavities in the closed position, the seal divided into two segments, each segment removable separately from the inner surface in the open position, wherein the first container is attached to the second container by a hinge and the seals are concealed in the closed position and exposed in the open position, the protrusions of the first container are generally aligned with the protrusions of the second container in the closed position, and the head end of the protrusions of the first container are proximate the tail end of the protrusions of the second container in the closed position. There can be first and second generally planar sheets of at least partially semi-transparent material having one of product information and promotional material, each sheet affixed to and extending between two of the elongated protrusions on one of the first and second containers.

BRIEF DESCRIPTION OF THE SEVERAL VIEWS OF THE DRAWINGS

The foregoing summary, as well as the following detailed description of an exemplary embodiment, will be better understood when read in conjunction with the appended drawings. It should be understood, however, that the invention is not limited to the precise arrangements and instrumentalities shown.

In the drawings.

DETAILED DESCRIPTION OF THE INVENTION

Figure 1:
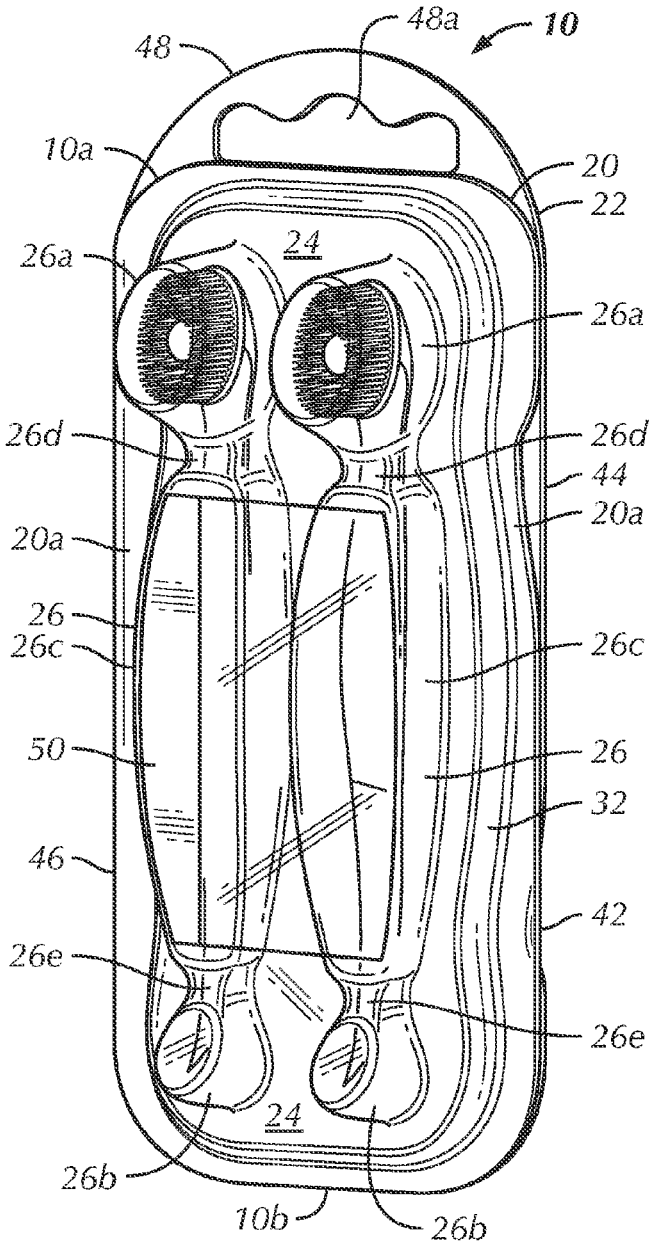
FIG. 1 is a front perspective view of a display package in a closed position in accordance with an exemplary embodiment of the present invention.

Referring to the drawings in detail, wherein like reference numerals indicate like elements throughout, there is shown in FIGS. 1-8, a display package (package), generally designated 10, in accordance with an exemplary embodiment of the present invention. The package 10 displays a plurality of elongated items 12 having a head end 12*a* and a tail end 12*b*. The items 12 may be any elongated item having a variable outer contour such as medical and oral care instruments, foodstuff items, or toys. The items 12 may be goods that are desirable to individually seal within the package 10.

Figure 2:
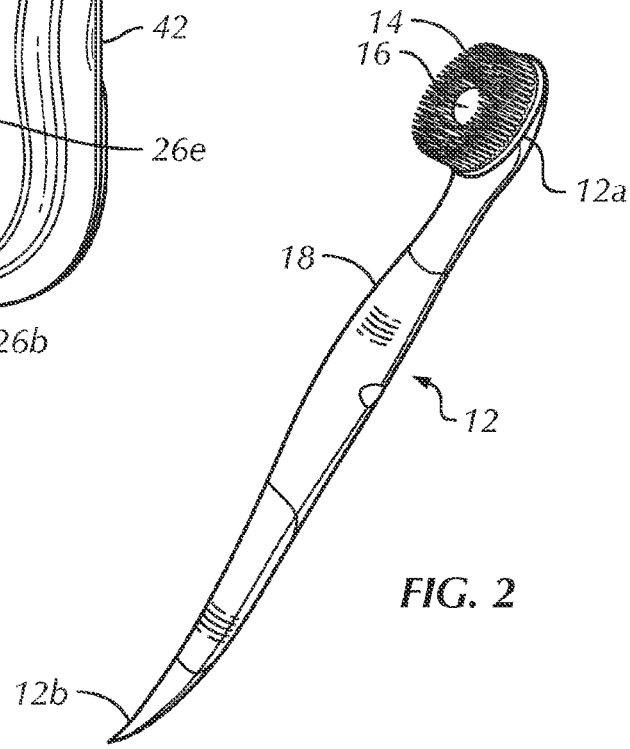
FIG. 2 is a front perspective view of an item removed from the package of FIG. 1.

Referring to FIG. 2, the items 12 are toothbrushes. Though any toothbrush may be used, the toothbrush may specifically be a single-use mini-toothbrush where the head end 12*a* may be in the form of a brush head containing a plurality of bristles 14 and a dentrifice bead 16 and the tail end may be in the form of a toothpick. The head end 12*a* may be a generally cylindrically shaped brush head and the tail end 12*b* may be a concavely curved and tapered tip connected by a convexly curved and elongated handle 18. The overall head thickness $T_h$ of the head end 12*a* may be larger than the overall tail thickness $T_t$ of the tail end 12*b* (see FIG. 6). Alternatively, the overall tail thickness $T_t$ of the tail end 12*b* could be larger than the overall head thickness $T_h$ of the head end 12*a*. Embodiments of mini-toothbrushes that may be contained within the package 10 are described in U.S. Patent Application Publication No. 2008/0120798 and are hereby incorporated by reference in their entirety.

Figure 3:
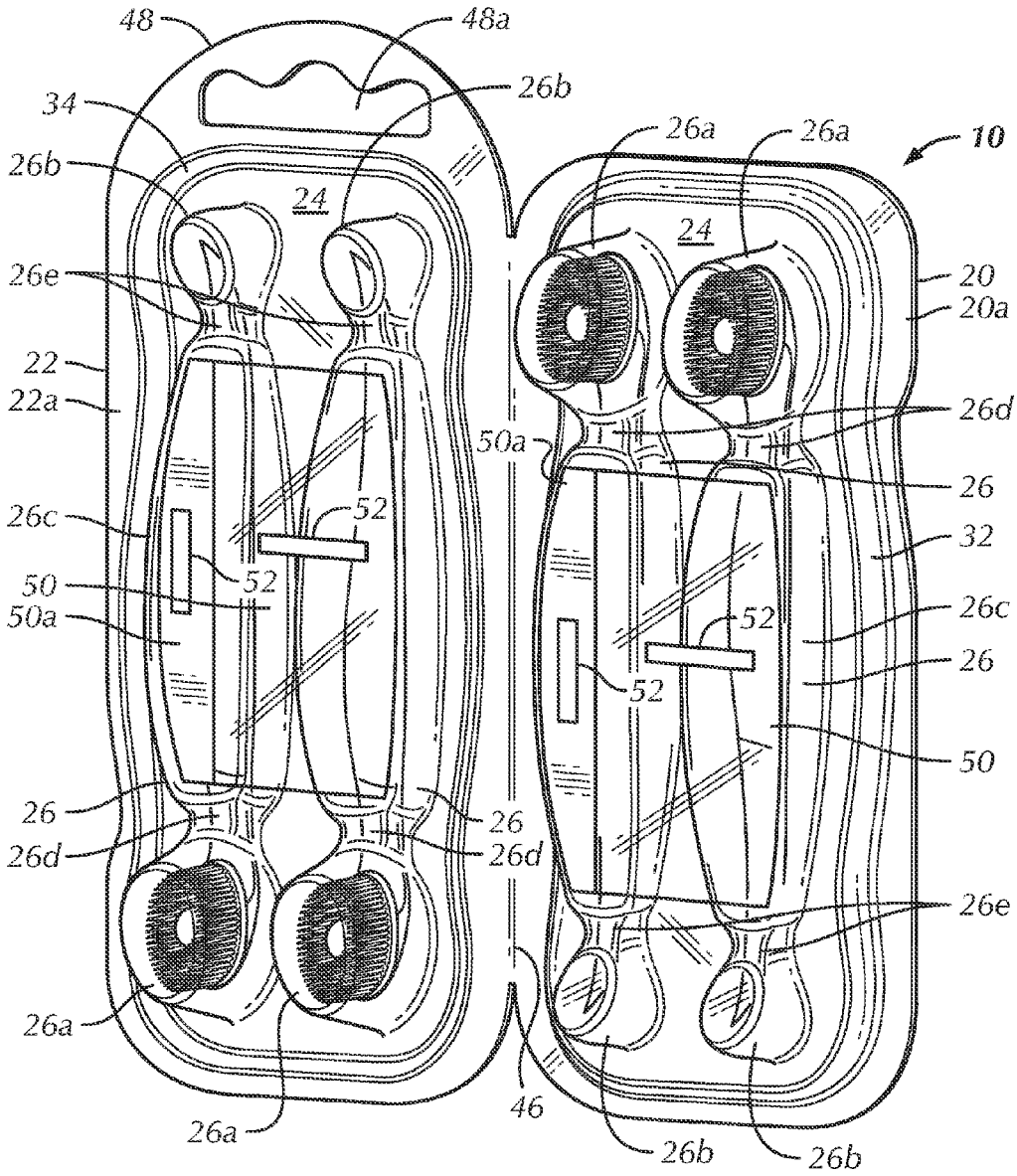
FIG. 3 is a front perspective view of the display package of FIG. 1 in an open position.

Referring to FIGS. 1 and 3, the package 10 is comprised of a transparent thermoformed polymeric material such that each of the items 12 may be entirely or at least partially visible through the package 10 and substantially impervious to outside elements. The package 10 is comprised of a polymeric material such as polyvinyl chloride (PVC) or polyethylene terephthalate (PET). However, the package 10 may be comprised of any polymeric material known for use in blister pack or clam-shell type packaging and may alternatively be comprised of any material or combination of materials, including partially transparent, semi-transparent, and/or opaque materials and may be formed in any manner such as injection or blow molding.

Referring to FIGS. 1 and 3, the package 10 includes a first container 20 that may be connectable to a second container 22 between a closed position (FIG. 1) and an open position (FIG. 3). Each container 20, 22 includes an outer surface 24 that has at least one elongated protrusion 26 extending outwardly from the package 10. The outer surface 24 is partially planar around the base of each protrusion 26. Each protrusion 26 further includes a head end 26*a* and a tail end 26*b*. Each head end 26*a* extends further outwardly from the package 10 than each tail end 26*b*. Each container 20, 22 may include any number of protrusions 26 having any shape. The at least one protrusion 26 of the first container 20 is substantially the same size and shape as the at least one protrusion of the second container 22. The first container 20 includes two substantially identical protrusions 26 and the second container 22 includes two substantially identical protrusions 26. The protrusions 26 of each container 20, 22 are laterally spaced apart from one another such that a portion of the outer surface 24 extends between the protrusions 26. The protrusions 26 of each container 20, 22 are generally parallel to one another. Alternatively, the protrusions 26 of each container 20, 22 may be angled laterally with respect to one another.

Figure 7:
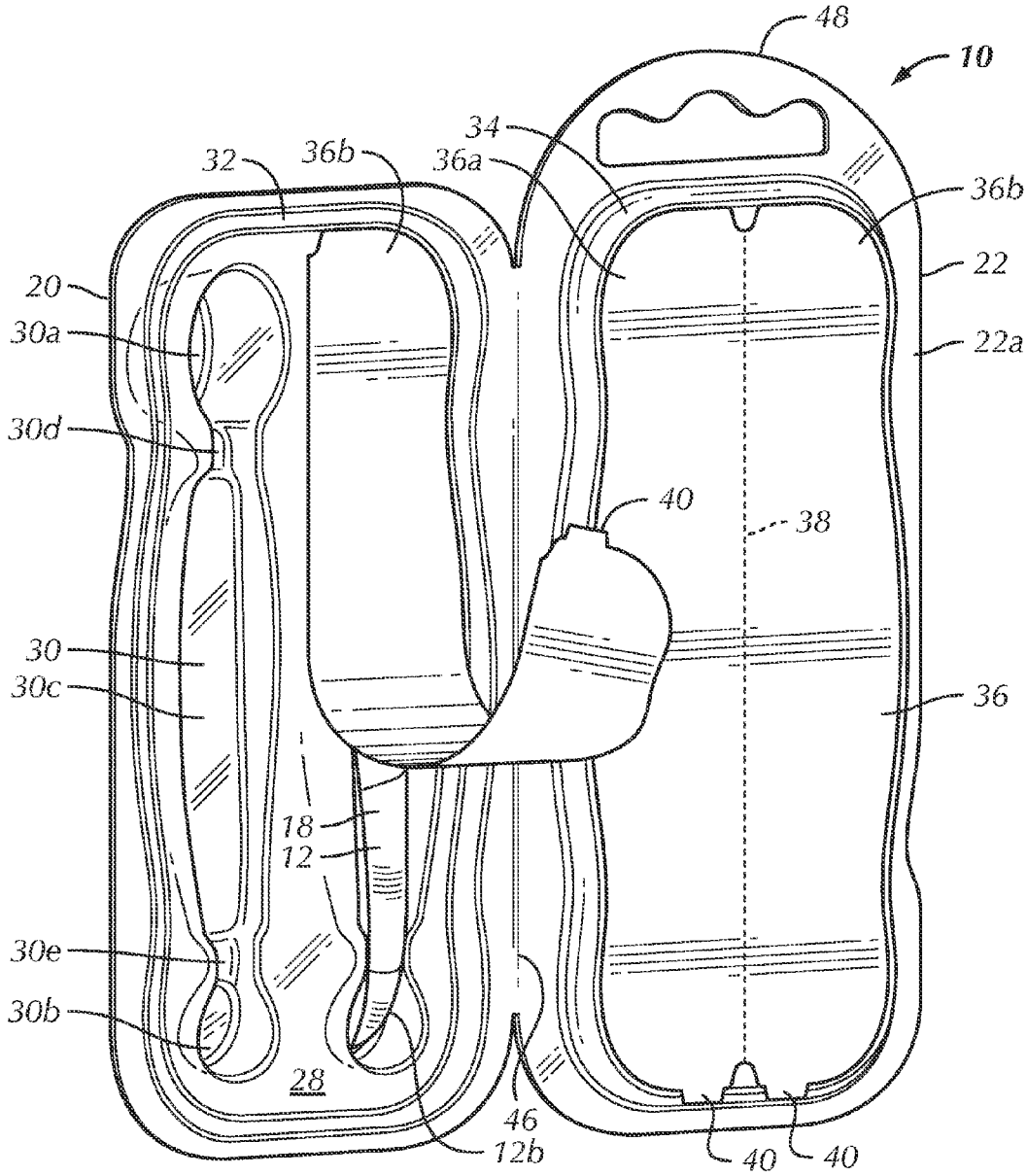
FIG. 7 is a rear perspective view of the display package of FIG. 3 with one of the seal segments, and corresponding item, removed from the display package and with one of the adjacent seal segments partially removed from the display package.

Referring to FIG. 7, each container 20, 22 includes an inner surface 28 (only one being visible) having at least one inner cavity 30. The inner surface 28 is partially planar and extends from the base of each cavity 30 and is parallel to the outer surface 24. Each cavity 30 is aligned with one of the protrusions 26. Each cavity 30 has a depth varying along the length of the corresponding protrusion 26 and is configured to receive one of the plurality of items 12. Each cavity 30 has a head end 30*a* corresponding to the head end 26*a* of one of the protrusions 26 and a tail end 30*b* corresponding to the tail end 26*b* of one of the protrusions 26. Each cavity 30 is substantially identical in shape to the corresponding protrusion 26. However, each cavity 30 may have a shape that differs from the corresponding protrusion 26. The cavities 30 are substantially identical to each other such that all of the protrusions 26 and their corresponding cavities 30 are substantially identical. However, the cavities 30 may be shaped differently.

Referring to FIGS. 1 and 3, the head and tail ends 26*a*, 26*b* of each protrusion 26 are generally bulbous in shape with a planar end surface and are connected to each other by a generally rectangular portion 26*c*. The head end 26*a* of each protrusion 26 has a similar shape as the head end 12*a* of the item 12, the tail end 26*b* of each protrusion 26 has a similar shape as the tail end 12*b* of the item 12 and the rectangular portion 26*c* has a similar shape as the handle 18 such that each protrusion 26 is generally similar in shape as the item 12. The shape of the protrusion 26 may differ from the shape of the item 12 due to molding preferences, creating sufficient affixing surfaces, and/or providing sufficient contact surfaces between packages 10 as discussed further below. The item 12 is positioned within the cavity 30 such that a side of the item 12 with the most variance in profile extends outwardly from the package 10. The shape of the cavity 30 and protrusions 26 generally conform to the item 12 using a minimal or reduced volume cavity 30 while sufficiently displaying the item 12. In the embodiment shown for example, the bristles 14 of the head end 12*a* face generally outwardly rather than inwardly. The items 12 may alternatively be arranged with the side of the item 12 with the greatest variance in profile facing laterally. Facing the side of the item 12 with the greatest variance in profile either laterally or outwardly and generally conforming the package 10 to each of the items 12 reduces the amount of material used to produce the package 10.

Figure 5:
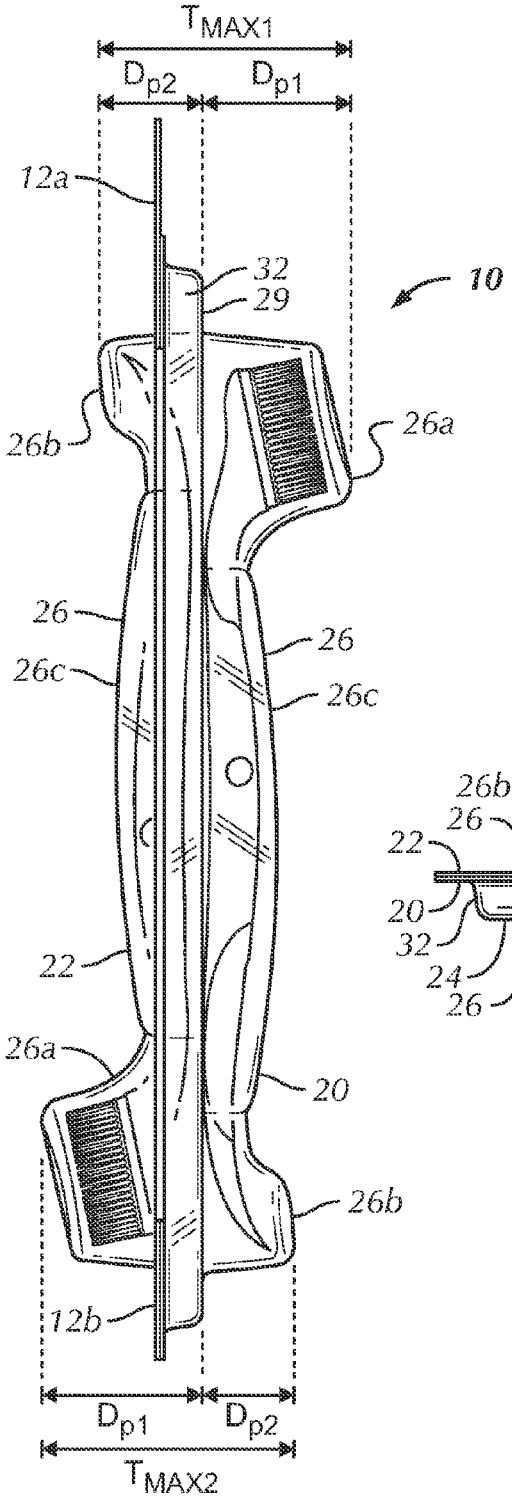
FIG. 5 is a side elevational view of the display package of FIG. 1.

Referring to FIG. 5, the head end 26*a* of each protrusion 26 extends outwardly from the respective outer surface 24 a first distance $D_{p1}$ and the tail end 26*b* of each protrusion 26 extends outwardly from the respective outer surface 24 a second distance $D_{p2}$. Each protrusion 26 has a first constricting segment 26*d* between the rectangular portion 26*c* and the head end 12*a* and a second constricting segment 26*e* between the rectangular portion 26*c* and the tail end 26*b* (FIG. 3). The rectangular portion 26*c* has a corresponding rectangular portion 30*c* within the cavity 30. The first and second constricting segments 26*d*, 26*e* have corresponding first and second segments 30*d*, 30*e* within the cavity 30 that contact the item 12 proximate the head end 12*a* and the tail end 12*b* respectively, and at least partially restrict the amount the item 12 moves within the cavity 30 (FIG. 7).

Figure 6:
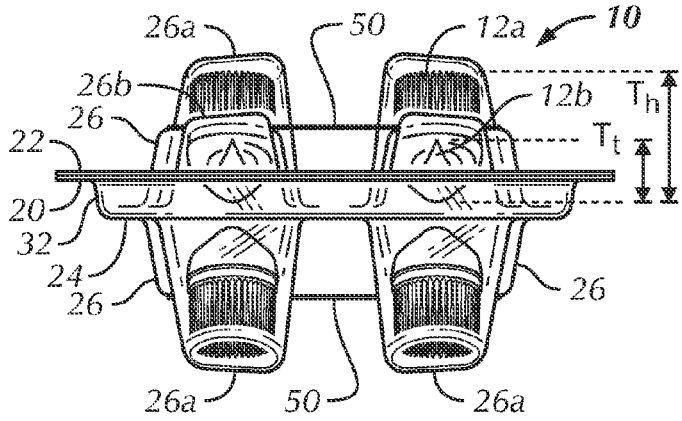
FIG. 6 is a top plan view of the display package of FIG. 1.

Referring to FIGS. 5 and 6, the head end 26*a* of each of the protrusions of the first container 20 are, at least initially, proximate the tail end 26*b* of each of the protrusions of the second container 22 in the closed position such that the items 12 of the first container 20 are arranged in a "head-to-tail" configuration with respect to the items in the second container 22. Each of the protrusions 26 of the first container 20 are generally aligned with one of the protrusions 26 of the second container 22 in the closed position. The protrusions 26 of the first container 20 are generally laterally aligned with one of the protrusions 26 of the second container 22 in the closed position (FIG. 6). The protrusions 26 of the first container 20 are generally vertically aligned with one of the protrusions 26 of the second container 22 in the closed position (FIG. 5). Although the package 10 shown contains two sets of back-to-back items 12 in the closed position, the package 10 may include one or more sets of back-to-back items 12 including two items 12, four items 12 or six or more items 12. The package 10 has a first maximum thickness $T_{MAX1}$ proximate a top 10*a* of the package 10 measured through the protrusions 26 in the closed position and a second maximum thickness $T_{MAX2}$ proximate a bottom 10*b* of the package 10 measured through the protrusions 26 in the closed position. The first maximum thickness $T_{MAX1}$ is generally equal to the second maximum thickness $T_{MAX2}$. The first and second maximum thicknesses $T_{MAX1}$ and $T_{MAX2}$ may be generally equal to the sum of the first and second distances $D_{p1}$ and $D_{p2}$ plus any spacing between the outer surfaces 24 of the first and second containers 20, 22. In the embodiment of FIG. 5, the first and second distances $D_{p1}$ and $D_{p2}$ are shown assuming the outer surfaces 24 of each container 20, 22 are co-planar for simplicity of the illustrated distances only and is not limiting.

Aligning the protrusions 26 of the first container 20 with the protrusions 26 of the second container 22 and arranging the protrusions 26 in a "head-to-tail" arrangement reduces the amount of material needed to sufficiently display each item 12 and facilitates a compact stack of two or more packages 10 (FIG. 8) during shipping, storage, and/or when on display as described further below.

Figure 4:
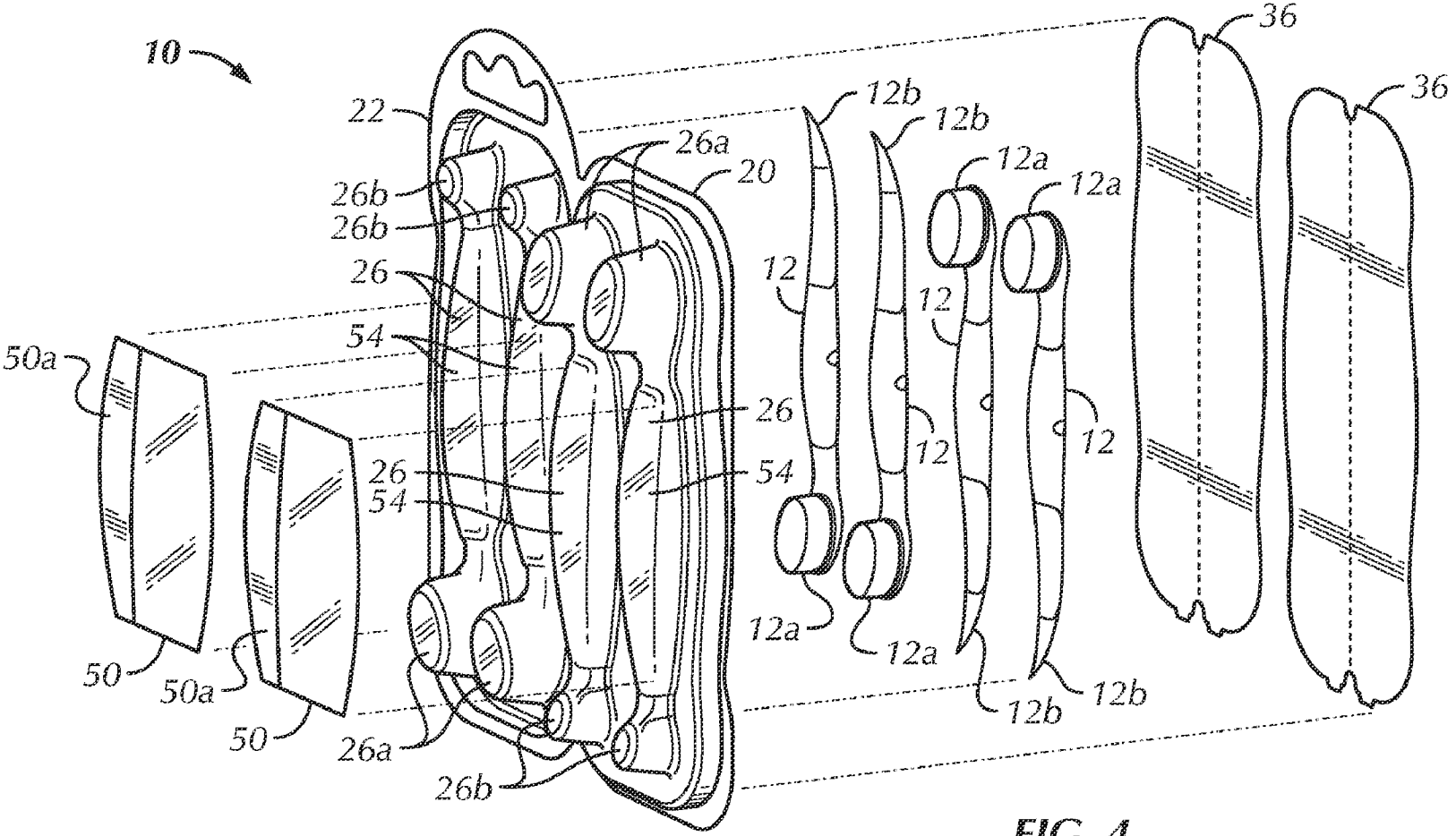
FIG. 4 is an exploded view of the display package shown in FIG. 3.

Referring to FIGS. 4 and 7, the first and second containers 20, 22 each include a seal 36 covering and sealing each of the cavities 30, at least initially, in the closed position. The seals 36 are each affixed to one of the inner surfaces 28 of the first and second containers 20, 22. The seals 36 may be partially or fully removable from the containers 20, 22 and/or may be puncturable to allow access one of the items 12 in the open position. The seals 36 are comprised of an opaque foil similar to foil used in known blister packages. The seals 36 may be alternatively comprised of any material such as a polymeric membrane and may be transparent or semi-transparent. Each seal 36 includes first and second seal segments 36*a*, 36*b* attached by a perforation 38 such that each seal segment 36*a*, 36*b* is individually removable from the respective container 20, 22 to individually access one of the items 12. Sealing each of the items 12 by an individual seal segment 36*a*, 36*b* allows for the remainder of the items 12 to be sealed alter accessing one of the items 12 (see FIG. 7). After accessing one or more of the items 12, the package 10 may be returned to the closed position and stored for later use. The seals 36 may be resealable such that the item 12 may be placed back in the respective cavity 30 after use and re-sealed. The seals 36 may be partially fixed to the respective container 20, 22 such that the seal 36 may remain on the respective container 20, 22 and eventually disposed of properly or resealed. The seals 36 are entirely removable from the respective container 20, 22 and separately disposed of to stay out of the way while accessing the remaining items 12 and for recycling the first and second packages 20, 22. Each seal segment 36*a*, 36*b* includes a seal tab 40 to assist in gripping and removal of each seal segment 36*a*, 36*b*. The seals 36 are contained within either a lip 32 or an edge 34, discussed below, such that the seals 36 are not affected by opening and closing the package 10 between the open and closed positions.

Referring to FIGS. 1, 5, 6 and 7, the first container 20 includes an outwardly extending lip 32 proximate an outer periphery 20*a* of the first container 20 such that the outer surface 24 of the first container 20 is spaced outwardly from the outer periphery 20*a*. The second container 22 includes an inwardly extending edge 34 (see FIG. 7) proximate an outer periphery 22*a* of the second container 22 such that the outer surface 24 of the second container 22 is spaced inwardly from the outer periphery 22*a*. The lip 32 is compression or snap fit with the edge 34 such that the first container 20 is releasably and selectably connectable with the second container 22 between the open and closed positions. The first and second packages 20, 22 may initially include a tamper evident seal (not shown) comprised of an epoxy, heat seal, spot weld, or wrap. The seals 36 are protected and concealed in the closed position and accessed or opened from the respective cavity 30 in the open position. The first and second containers 20, 22 may be re-closed after accessing an item 12 such that the remaining seals 36 are protected by the first and second containers 20, 22 until an additional item 12 is desired.

Referring to FIGS. 1 and 3, the outer periphery 20*a* of the first container 20 includes a first gripping tab 42 and the outer periphery 22*a* of the second container 22 includes a second gripping tab 44 vertically spaced from the first gripping tab 44. The first and second gripping tabs 42, 44 are created by varying the profile of one of the outer peripheries 20*a*, 22*a* with respect to the other. The first and second containers 20, 22 are attached to each other by a hinge 46 at least partially extending along a lateral edge. Alternatively, the first and second container 20, 22 may be completely detachable from one another.

Figure 8:
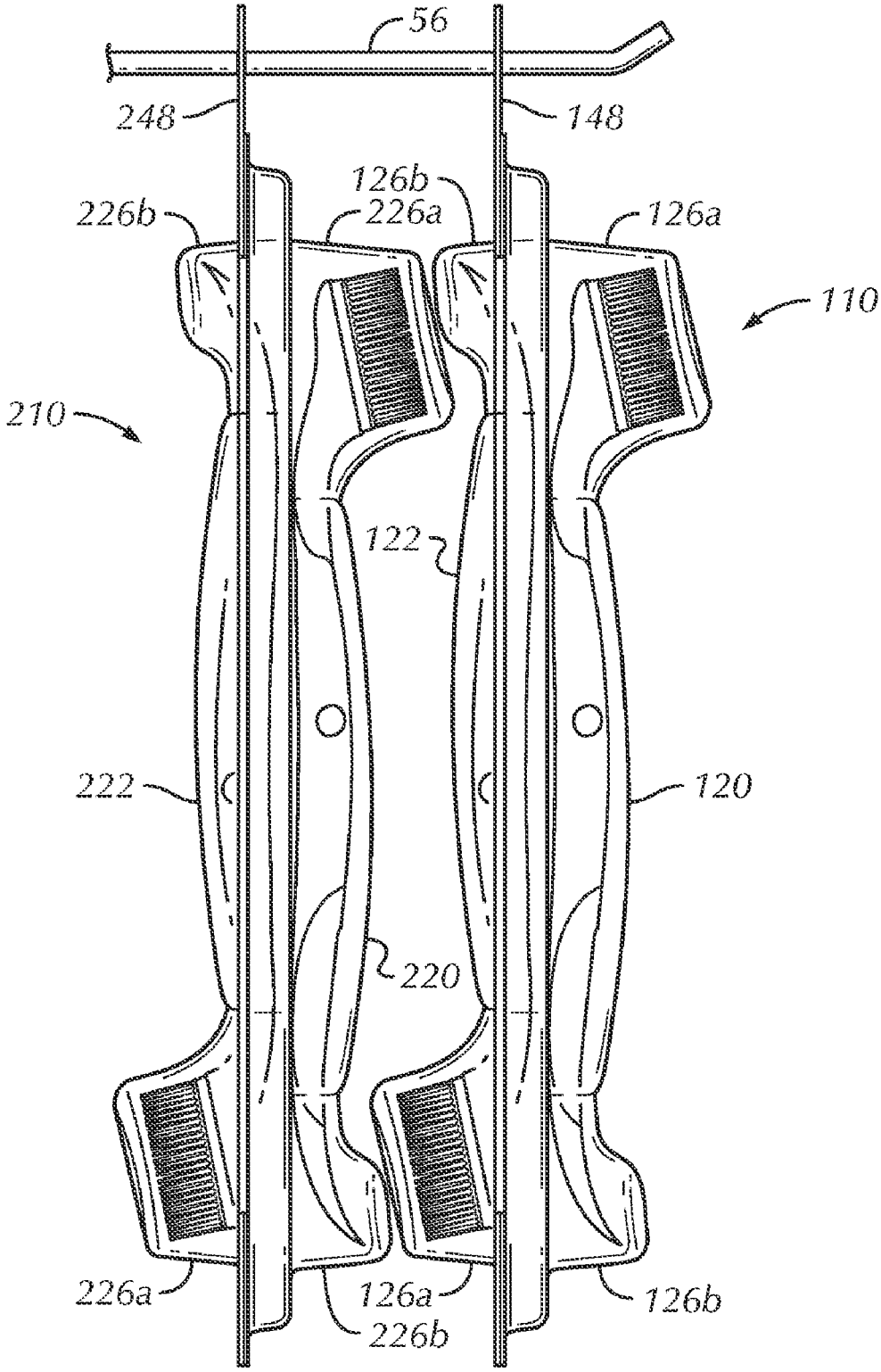
FIG. 8 is a side elevational view of two of the display packages shown in FIG. 1 on display.

Referring to FIGS. 3 and 8, the second container 22 includes a vertically extending display tab 48. The display tab 48 includes an aperture 48*a* extending therethrough. The aperture 48*a* allows for one or more packages 10, 110, 210 to be hung from and displayed on a prong 56. The aperture 48*a* may be open toward a lateral side of the display tab 48 such that the display tab 48 forms a hook (not shown). The display tab 48 may alternatively, or in addition, extend from the first container 20. The display tab 48 extends from the top 10*a* of the package 10 such that the items 12 are displayed vertically. Alternatively, the display tab 48 may extend in any direction from the package 10, be removable from the package 10 or not be included at all.

In use, and referring to FIGS. 1 and 3, a user grips the first gripping tab 42 with a first index finger and a first thumb (not shown) or presses on the first gripping tab 42 with just the first thumb and grips the second gripping tab 44 with a second index finger and a second thumb or presses on the second gripping tab 44 with just the second thumb and pull or push the first and second gripping tabs 42, 44 in opposite directions until a sufficient force overcomes the compression or snap fit between the lip 32 and the edge 34 and any initial seal between the first and second containers 20, 22. Once the lip 32 and the edge 34 are detached from one another, the first container 20 may be pivoted with respect to the second container 22 about the hinge 46 to the open position. The user then grips one of the seal tabs 40 and pulls upwardly and outwardly until a sufficient force overcomes the bond between the seal 36 and the respective container 20, 22. Alternatively, the user may push one of the protrusions 30 inwardly until the item 12 pushes against the seal segment 36*a* and either detaches the seal segment 36*a* from the respective container 20, 22 or the item 12 punctures and extends through the seal segment 36*a*. Once the item 12 is at least partially exposed, the user then removes and uses the item 12. The item 12 is discarded after use. However, the item 12 may be placed back in the respective cavity 30.

Referring to FIG. 3, the package 10 includes a generally planar sheet of material (sheet) 50 affixed to and extending between two laterally spaced protrusions 26. In embodiments including a sheet 50, the protrusions 26 are not limited to any specific configuration and the package 10 need not contain two containers 20, 22. However, if two containers 20, 22 are included, either one of or both the first and second containers 20, 22 may include a separate sheet 50 as shown.

The sheet 50 includes one of product information and promotional material (print), generally 52, printed thereon. The print 52 may also include additional indicia such as logos, graphics, colors, and ornamental designs. The sheet 50 is comprised of at least partially semi-transparent polymeric material such that at least a portion of one of the items 12 remains visible through the package 10 and sheet 50. The sheet 50 may alternatively be substantially transparent or opaque and be comprised of any material, such as paper. The sheet 50 has an opaque portion 50*a* with print 52 so that the print 52 such as a brand name, is more clearly and prominently shown on the sheet 50. The sheet 50 has a thickness less than the thickness of the material used to form the first and second containers 20, 22. The sheet 50 is thinner than the material of the first and second containers 20, 22 because the integrity of the sheet 50 is not as critical as the integrity of the first and second containers 20, 22 thereby reducing the amount of material used to manufacture the sheet 50 and ultimately the package 10. The sheet 50 is attached to the protrusions 26 using an epoxy. Alternatively, the sheets 50 may be heat welded on to the protrusions 26. The sheet 50 is confined between the outer lateral edges of the protrusions 26. The sheet 50 spans the space between the protrusions 26 and provides sufficient space for the desired print 52. Each sheet 50 is attached to the respective container 20, 22 in a similar vertical configuration such that either the first container 20 or the second container 22 may be considered the "front" in the closed position. Use of the sheet 50 for displaying the print 52 reduces the size needed for the first and second protrusions 26 and thereby reduces the amount of material used in manufacturing the first and second containers 20, 22. The elongated rectangular portions 26*c* of each of the protrusions 26 have a generally planar surface 54 (see FIG. 4) sufficiently wide to provide an attachment and support surface for each sheet 50.

Referring to FIG. 8, the exemplary package of FIGS. 1-7 may be used to perform a method of displaying a plurality of items 12 within a plurality of packages 110, 210. First and second packages 110, 210 are manufactured to be substantially identical to one another and may include any combination of the above described features and configurations. Each package 110, 210 is formed by thermoforming a sheet of polymeric material to form the first and second containers 20, 22 of each package 110, 210 in an open position having a shape as described above. The items 12 are placed in each corresponding cavity 30 of the first and second packages 110, 210. Each item 12 is sealed within one of the cavities 30 by a seal 36 or seal segment 36*a*, 36*b* as discussed above. A sheet 50 is attached to each container 20, 22 as described above. The first container 20 is then connected with the second container 22 such that the seals 36 are protected or concealed in the closed position as discussed above. The closed package 110, 210 are then stored or placed on display. The displayed packages 110, 210 are mounted on a prong 56 or otherwise hung from each display tab 148, 248. The packages 110, 210 may alternatively, be stacked in a display container (not shown). The sheet 50 (not visible in FIG. 8) of the top or front most package 110 on display is visible to a consumer who is looking at the packages 110, 210 on display. The items 12 within the first container 120 are at least partially viewed through the package 110 while on display. The items 12 within the second container 122 are at least partially viewed through the package 110 after removing the package 110 from the prong 56. The head ends 126*a* of the protrusions 126 of the second container 122 of the first package 110 are in contact with the tail ends 226*b* of the protrusions 226 of the first container 220 of the second package 210. The tail ends 126*b* of the protrusions 126 of the second container 122 of the first package 110 are in contact with the head ends 226*a* of the protrusions 226 of the first container 220 of the second package 210. The alignment of the protrusions 126, 226 and the "head-to-tail" configuration of the protrusions 126, 226 within each package 110, 210 allows the stack of packages 110, 210 to form a generally rectangular and compact stack when on display while minimizing the amount of packaging material used to manufacture the first and second packages 110, 210.

It will be appreciated by those skilled in the art that changes could be made to the exemplary embodiment shown and described above without departing from the broad inventive concept thereof. It is understood, therefore, that this invention is not limited to the exemplary embodiment shown and described, but it is intended to cover modifications within the spirit and scope of the present invention as defined by the appended claims. For example, "an embodiment," and the like, may be inserted at the beginning of every sentence herein where logically possible and appropriate such that specific features of the exemplary embodiment may or may not be part of the claimed invention. The words "inwardly" and "outwardly" refer to directions toward and away from, respectively, the geometric center of the package 10. Unless specifically set forth herein, the terms "a", "an" and "the" are not limited to one element but instead should be read as meaning "at least one".

Further, to the extent that a method does not rely on the particular order of steps set forth herein, the particular order of the steps should not be construed as limitation on the claims. Claims directed to the method of the present invention should not be limited to the performance of their steps in the order written, and one skilled in the art can readily appreciate that the steps may be varied and still remain within the spirit and scope of the present invention.

We claim:

1. A package for displaying a plurality of items comprising:

first and second containers connectable between an open position and a closed position, each container having:

an outer surface having at least two elongated protrusions, the at least two protrusions each having a head end and a tail end, the head end extending further outwardly from the package than the tail end, an inner surface having at least one inner cavity aligned with each of the at least two protrusions, the cavity having a depth varying along the protrusion and configured to receive one of the plurality of items, and wherein the at least two protrusions having substantially identical cavities, the head ends of the protrusions of the first container being proximate the tail ends of the protrusions of the second container in the closed position; and a first removable seal affixed to the inner surface of the first container sealing the cavities of the first container and a second removable seal affixed to the inner surface of the second container sealing the cavities of the second container, the first and second seals being concealed in the closed position and removable from the respective first and second container in the open position, wherein the first and second removable seals are each separable into at least two segments, each segment configured to individually seal one of the cavities.

2. The package of claim 1, wherein the at least two protrusions of the first container are substantially the same size and shape as the at least two protrusions of the second container.

3. The package of claim 1, wherein the protrusions of each container are laterally spaced from one another.

4. The package of claim 3 further comprising:

a generally planar front sheet of material affixed to and extending between the protrusions of the first container.

5. The package of claim 4 further comprising:

a generally planar rear sheet of material affixed to and extending between the protrusions of the second container.

6. The package of claim 3, wherein each of the protrusions of the first container are generally aligned with one of the protrusions of the second container in the closed position.

7. The package of claim 1, further comprising:

a toothbrush positioned within the at least one cavity.

8. The package of claim 7, wherein each of the cavities and the corresponding protrusion are generally the same shape as the toothbrush.

9. The package of claim 7, wherein the toothbrush includes a brush head received in the head end of the protrusion configured to face generally outwardly from the package in the closed position.

10. The package of claim 1, wherein the package has a first maximum thickness proximate a top of the package measured through the protrusions in the closed position and a second maximum thickness proximate a bottom of the package measured through the protrusions in the closed position, the first maximum thickness being generally equal to the second maximum thickness.

11. The package of claim 1, wherein the first container is attached to the second container by a hinge.

12. The package of claim 1, wherein the head and tail ends of each of the at least one protrusions are generally bulbous and are joined together by a generally rectangular portion.

13. The package of claim 1, wherein first container has a lip proximate an outer periphery of the wall of the first container and the second container has an edge proximate an outer periphery of the wall of the second container, the lip of the first container releasably engaging with the edge of the second container in the closed position.

14. The package of claim 5, wherein at least one of the planar front sheet of material or the planar rear sheet of material is at least partially semi-transparent.

15. A disposable display package comprising:

four toothbrushes;

first and second containers connectable between an open position and a closed position, each container having an outer surface having two elongated protrusions generally parallel to each other and spaced laterally apart from one another, the protrusions each having a generally bulbous head end and a generally bulbous tail end, the head end extending outwardly further than the tail end, the first and second generally bulbous ends joined together by a generally rectangular portion, an inner surface having two cavities each shaped similar to and aligned with one of the protrusions, each cavity containing one of the toothbrushes, and a removable seal affixed to the inner surface of the container and individually sealing each of the cavities in the closed position, the seal divided into two segments, each segment removable separately from the inner surface in the open position, wherein the first container is attached to the second container by a hinge and the seals are concealed in the closed position and exposed in the open position, the protrusions of the first container are generally aligned with the protrusions of the second container in the closed position, and the head end of the protrusions of the first container are proximate the tail end of the protrusions of the second container in the closed position.

16. The package of claim 15 further comprising:

first and second generally planar sheets of at least partially semi-transparent material having one of product information and promotional material, each sheet affixed to and extending between two of the elongated protrusions on one of the first and second containers.

* * * * *